US005697733A

United States Patent [19]

Marsh, Jr.

[11] Patent Number: 5,697,733

[45] Date of Patent: Dec. 16, 1997

[54] CENTRIFUGAL FORCE VIBRATION APPARATUS AND SYSTEM

[76] Inventor: Richard O. Marsh, Jr., 405 Meadow La., Sewickley, Pa. 15143

[21] Appl. No.: 584,747

[22] Filed: Jan. 11, 1996

[51] Int. Cl.[6] ..... A01B 35/00; A01B 35/32; E02D 5/34; E21B 7/24; E21B 7/26

[52] U.S. Cl. ..... 405/233; 172/40; 175/19; 175/21; 175/56; 366/123; 405/240

[58] Field of Search ..... 405/228, 232, 405/240, 233; 175/19, 21, 23, 56; 404/117; 172/40; 366/123

[56] References Cited

U.S. PATENT DOCUMENTS

| | | | |
|---|---|---|---|
| 2,389,709 | 11/1945 | Anders | 91/197 |
| 2,528,386 | 10/1950 | Napper | 74/55 |
| 3,142,901 | 8/1964 | Bodine | 29/525 |
| 3,286,536 | 11/1966 | Hallmann | 74/84 |
| 3,507,162 | 4/1970 | Nomura et al. | 74/394 |
| 3,513,713 | 5/1970 | Schumacher | 74/55 |
| 3,584,515 | 6/1971 | Matyas | 74/84 |
| 3,612,188 | 10/1971 | Ono | 173/122 |
| 3,800,889 | 4/1974 | Bauer | 175/56 X |
| 3,807,244 | 4/1974 | Estrade | 74/84 S |
| 3,810,394 | 5/1974 | Novak | 74/87 |
| 3,871,617 | 3/1975 | Majima | 254/29 R |
| 3,964,322 | 6/1976 | Kieper | 74/55 |
| 3,968,700 | 7/1976 | Cuff | 74/84 S |
| 3,998,107 | 12/1976 | Cuff | 74/84 S |
| 4,095,460 | 6/1978 | Cuff | 74/84 S |
| 4,152,953 | 5/1979 | Headley | 74/569 |
| 4,184,787 | 1/1980 | Uebel | 404/117 |
| 4,238,968 | 12/1980 | Cook | 74/84 R |
| 4,241,615 | 12/1980 | Ryan | 74/61 |
| 4,318,446 | 3/1982 | Livesay | 173/13 |
| 4,408,740 | 10/1983 | Kleber | 244/158 R |
| 4,421,180 | 12/1983 | Fleishman et al. | 173/124 |
| 4,570,616 | 2/1986 | Kunz et al. | 128/36 |
| 4,579,011 | 4/1986 | Dobos | 74/84 R |
| 4,631,971 | 12/1986 | Thornson | 74/84 R |
| 4,662,459 | 5/1987 | Bodine | 175/56 |
| 4,712,439 | 12/1987 | North | 74/84 R |
| 4,788,882 | 12/1988 | Fulop | 74/572 |
| 5,042,313 | 8/1991 | Montalbano | 74/84 R |
| 5,282,699 | 2/1994 | Hodge | 405/271 |
| 5,328,299 | 7/1994 | Degen et al. | 405/232 X |
| 5,388,470 | 2/1995 | Marsh, Jr. | 74/84 R |

FOREIGN PATENT DOCUMENTS

| | | |
|---|---|---|
| 933483 | 4/1948 | France . |
| 2288882 | 6/1976 | France . |
| 2610646 | 9/1977 | Germany . |
| 573912 | 3/1958 | Italy . |
| 52-4952 | 1/1977 | Japan . |
| 57-157075 | 9/1982 | Japan . |
| 59-63375 | 4/1984 | Japan . |
| 81820 | 5/1956 | Netherlands . |
| 63188 | 9/1912 | Switzerland . |
| 932782 | 7/1963 | United Kingdom . |
| 2096268 | 10/1982 | United Kingdom . |

OTHER PUBLICATIONS

*Vibroflotation AG*, Jan. 1991, pp. i–ii and 1–19.

*Applications for the new Vibroflot RS3600*, Vibroflotation AG, Jan. 1991, pp. i–ii and 1–21.

*Primary Examiner*—Tamara L. Graysay

*Assistant Examiner*—Tara L. Mayo

*Attorney, Agent, or Firm*—Kirk D. Houser; Eckert Seamans Cherin & Mellott, LLC

[57] ABSTRACT

An apparatus for use in compacting or densifying soils includes a tubular casing having a vertical longitudinal axis and an inside surface; a hollow tubular drive shaft aligned with the vertical longitudinal axis of the tubular casing and mounted for rotation therein; a drive motor for rotating the drive shaft; a carrier attached to the drive shaft for rotation therewith; and a cylindrical roller weight in rolling contact with the inside surface of the tubular casing. The carrier engages the roller weight for rotation about the vertical longitudinal axis of the tubular casing. The centrifugal force resulting from rotation of the roller weight is resisted by the tubular casing thereby causing vibration thereof.

20 Claims, 5 Drawing Sheets

CENTRIFUGAL FORCE VIBRATION APPARATUS AND SYSTEM

BACKGROUND OF THE INVENTION

1. Field of the Invention

This invention relates to a device for compacting or densifying soils. More particularly, this invention relates to such a device employing centrifugal force to vibrate and compact or densify soils. This invention also relates to a system, including a device employing centrifugal force to vibrate and compact or densify soils, for installing vertical structural columns therein.

2. Background Information

Vibroflotation is a method of compacting or densifying loose, granular soils, such as gravel, sand, silt and clay, to improve their bearing capacity. Vibroflotation AG, Jan. 1991, discloses a V23 Vibroflot vibratory device known to attempt compacting of soils. The vibratory device includes a cylindrical casing which is connected to the lower end of a first longitudinal follow-up-tube by a vibration damper. Additional follow-up-tubes and vibration dampers are added to the upper end of the first follow-up-tube to increase the total longitudinal length. Depending on soil conditions, the length of the vibratory device and the longitudinally connected follow-up-tubes may be up to about 100 feet.

The lower end of the cylindrical casing has a pointed nose cone which is placed on loose, granular soil and vibrated at about 1800 RPM in a circular motion. In turn, the nose cone sinks into the soil, creates an annular void, and compacts and increases the bearing capacity of the surrounding ground. The void is filled with sand or other suitable filler material, such as concrete, as the nose cone is withdrawn therefrom. The void, along with a number of other compaction points, typically form a grid pattern.

As illustrated in FIG. 1, a prior art vibratory device 2 includes a casing 4, an electric drive motor 6, a drive shaft 8 having an eccentric weight 10, bearings 12, 14, and a nose cone 16. The vibratory device 2 is connected to one or more longitudinally connected follow-up-tubes (not shown) by a vibration damper (not shown). The drive motor 6, supported at the upper end of the casing 4, has a rotating motor shaft 18 which turns the drive shaft 8. In this manner, the draft shaft 8 rotates the eccentric weight 10.

The drive shaft 8 is supported by the upper bearing 12 adjacent the drive motor 6 and the lower bearing 14 in the nose cone 16. As the drive shaft 8 is rotated by the motor shaft 18 of the drive motor 6, the eccentric weight 10 develops a centrifugal force which causes the casing 4 to vibrate in a circular pattern 20 about the vertical longitudinal axis 22 of the casing 4. The centrifugal vibrating force is transmitted by the upper bearing 12, as well as the lower bearing 14 and the nose cone 16, to the casing 4 which, in turn, transmits such force to the surrounding soil 24.

The bearings 12, 14 are subject to wear caused by the centrifugal vibrating force. It is believed that the bearings 12,14 limit the maximum centrifugal vibrating force to about 300 kN.

Applications for the new Vibroflot RS3600, Vibroflotation AG, Jan. 1991, discloses configurations of two, three or four parallel vibratory devices which are disposed about a central longitudinal steel body. The steel body encloses a longitudinal concrete filling pipe therein parallel to the vibratory devices. In this manner, concrete for filling the annular void may be routed, separate from the vibratory devices, through the longitudinal concrete filling pipe.

SUMMARY OF THE INVENTION

I provide a centrifugal force vibration apparatus for use in compacting or densifying soils. I provide such an apparatus including a tubular casing means having a vertical longitudinal axis and an inside surface; a drive shaft aligned with the vertical longitudinal axis of the tubular casing means and mounted for rotation therein; a drive motor for rotating the drive shaft; a carrier means attached to the drive shaft for rotation therewith; and a roller means in rolling contact with the inside surface of the tubular casing means, the carrier means engaging the roller means for rotation about the vertical longitudinal axis of the tubular casing means, whereby centrifugal force resulting from rotation of the roller means is resisted by the tubular casing means thereby causing vibration thereof.

I may provide a tubular casing means including a tubular casing having a longitudinal length which is aligned with the longitudinal axis of the tubular casing means, and an end cap means attached to an end of the tubular casing. The end cap means includes a conical member attached to the end of the tubular casing. Preferably, the drive shaft is a hollow tubular member aligned with the longitudinal length of the tubular casing. The conical member has a longitudinal passageway extending therethrough, with the hollow tubular member extending through the drive motor and into the longitudinal passageway of the conical member. The end cap means includes a plug disposed within the longitudinal passageway of the conical member at about the end of the hollow tubular member.

I may provide a carrier means including a first carrier and a second carrier, with the roller means rotatably supported between the first and second carriers. The end cap means includes bearing means for rotatably supporting the second carrier. The roller means includes a first end, a second end and a cylindrical roller portion therebetween. The carrier means includes first bearing means for rotatably supporting the first end of the roller means at the first carrier of the carrier means, and second bearing means for rotatably supporting the second end of the roller means at the second carrier of the carrier means, with the cylindrical roller portion of the roller means rolling about the inside surface of the tubular casing means.

The centrifugal force vibration apparatus may be assembled as part of a centrifugal force vibration system for use in compacting or densifying soils. I provide a system including a tubular casing having a vertical longitudinal axis, an inside surface and an upper end; a means for supporting the upper end of the tubular casing; a drive shaft aligned with the vertical longitudinal axis of the tubular casing and mounted for rotation therein; a drive motor for rotating the drive shaft; a carrier means attached to the drive shaft for rotation therewith; and a roller means in rolling contact with the inside surface of the tubular casing, the carrier means engaging the roller means for rotation about the vertical longitudinal axis of the tubular casing, whereby centrifugal force resulting from rotation of the roller means is resisted by the tubular casing thereby causing vibration thereof.

The centrifugal force vibration apparatus may be assembled as part of a centrifugal force vibration system for use in compacting or densifying soils and installing vertical structural columns therein. I provide a system including a tubular casing having a vertical longitudinal axis, an inside surface, an upper end and a lower end; a means for at least supporting the upper end of the tubular casing; an end cap means attached to the lower end of the tubular casing; a hollow tubular drive shaft aligned with the vertical longitudinal axis of the tubular casing and mounted for rotation therein, the hollow tubular drive shaft having an outside surface; a drive motor between the inside surface of the tubular casing and the outside surface of the hollow tubular drive shaft for rotating the hollow tubular drive shaft; a carrier means attached to the outside surface of the hollow tubular drive shaft for rotation therewith; and a roller means in rolling contact with the inside surface of the tubular casing, the carrier means engaging the roller means for rotation about the vertical longitudinal axis of the tubular casing, whereby centrifugal force resulting from rotation of the roller means is resisted by the tubular casing thereby causing vibration thereof.

I may provide an end cap means including a conical member attached to the lower end of the tubular casing, with the conical member having a longitudinal passageway extending therethrough and with the hollow tubular drive shaft extending through the drive motor and into the longitudinal passageway of the conical member. The end cap means includes a plug disposed within the longitudinal passageway of the conical member at about the end of the hollow tubular drive shaft.

I preferably provide a means for pressurizing the inner surface of the hollow tubular drive shaft, thereby pressurizing the longitudinal passageway of the conical member to eject a removable plug from the longitudinal passageway of the conical member.

I may also provide a means for lifting the tubular casing from a hole in the soils and a means for injecting fill through the upper end of the hollow tubular drive shaft to the lower end thereof, through the longitudinal passageway of the conical member and into the hole.

Other details, objects, and advantages of my invention will become more apparent as the following description of a present preferred embodiment thereof proceeds.

BRIEF DESCRIPTION OF THE DRAWINGS

In the accompanying drawings, I have illustrated a present preferred embodiment of my invention in which.

DESCRIPTION OF THE PREFERRED EMBODIMENT

As employed herein, the term "soil "or "soils "is intended to include, but shall not be limited to, earth, ground, gravel, sand, silt, clay and a wide range of loose, granular soils.

As employed herein, the term "structural columns "is intended to include, but shall not be limited to, piles, stone columns, concrete columns, sand columns, gravel columns and other columns formed from a wide range of structural materials.

As employed herein, the term "fill "is intended to include, but shall not be limited to, stone, concrete, sand, gravel and a wide range of other structural filler materials for structural columns.

Figure 1:
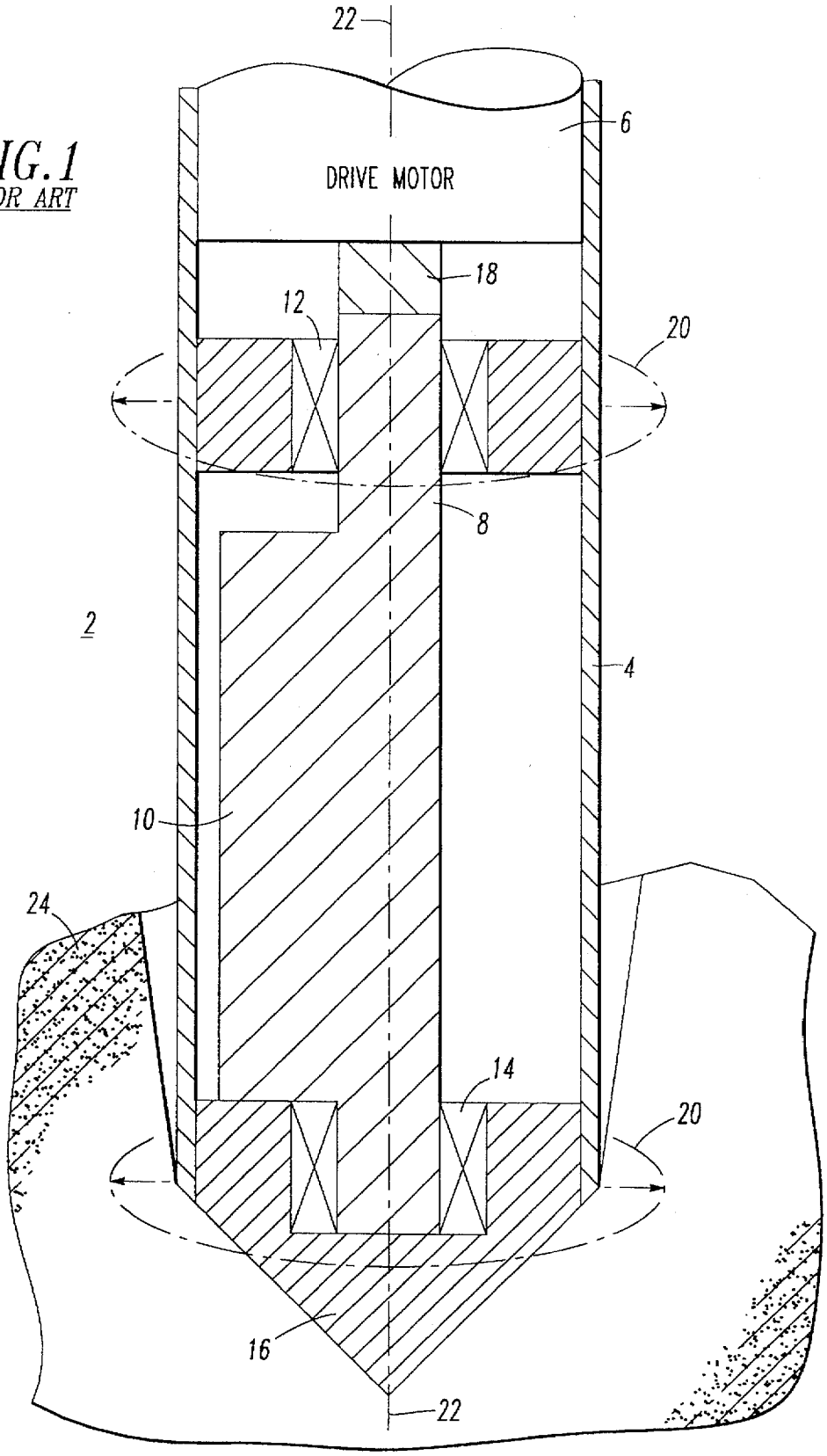
FIG. 1 PRIOR ART
FIG. 1 is a cross-sectional view of a prior art vibratory device.
Figure 2:
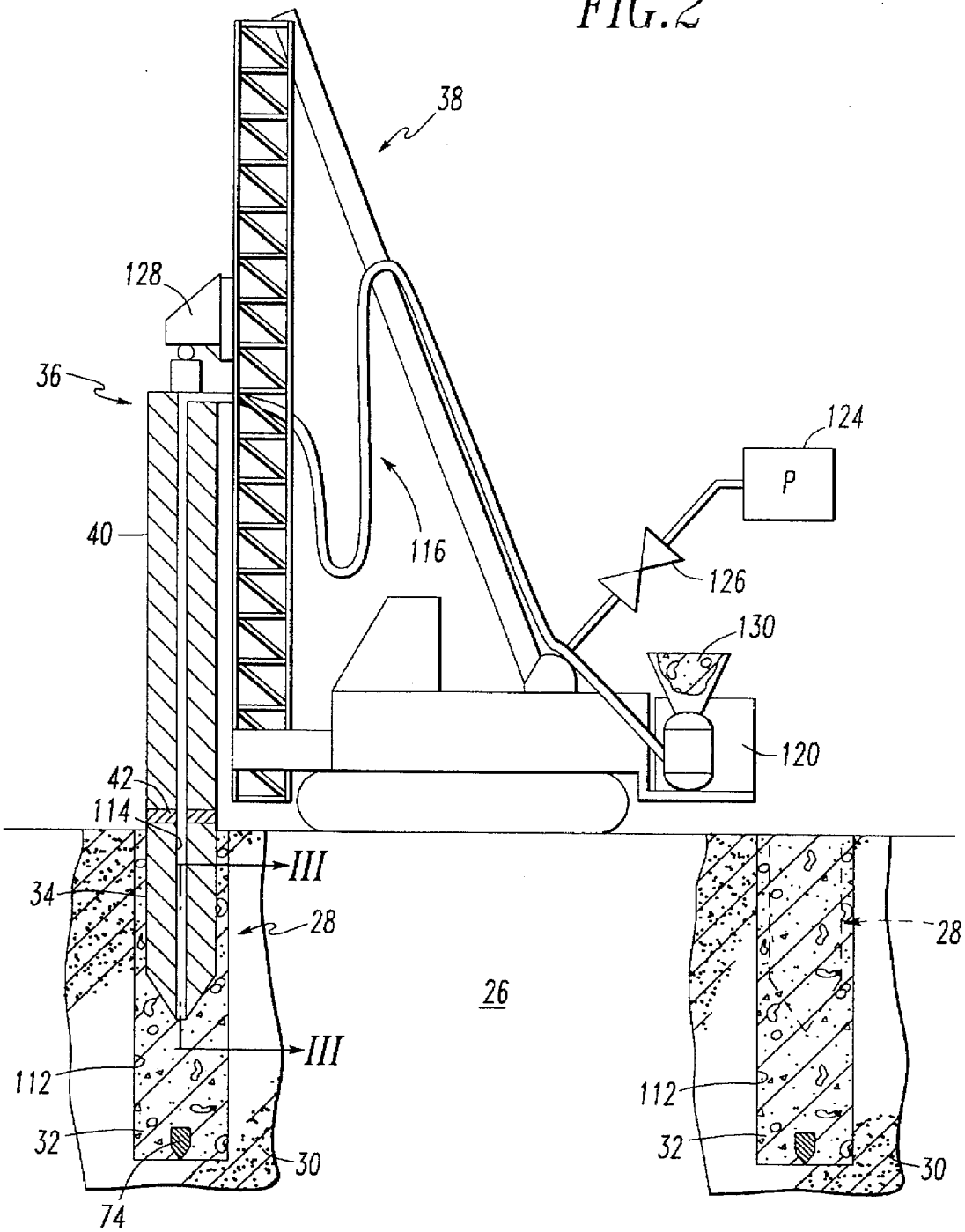
FIG. 2 is a side view, with some parts cut away, of a vibration system and a vibration device in accordance with the invention.

Referring to FIG. 2, a vibration system 26 including a vibration device 28 is illustrated. The system 26 and the device 28 are used to compact or densify soils 30 surrounding the device 28. The system 26 is also used to install vertical structural columns 32 in the soils 30.

The vibration device 28 includes a tubular casing 34. The system 26 includes a support mechanism 36 which supports the upper end of the tubular casing 34. The support mechanism 36 includes a crane assembly 38 which supports a follow-up-tube 40 interconnected by a vibration damper 42 with the upper end of the tubular casing 34. Alternatively, zero or plural follow-up-tubes may be employed in supporting the tubular casing 34.

Figure 3:
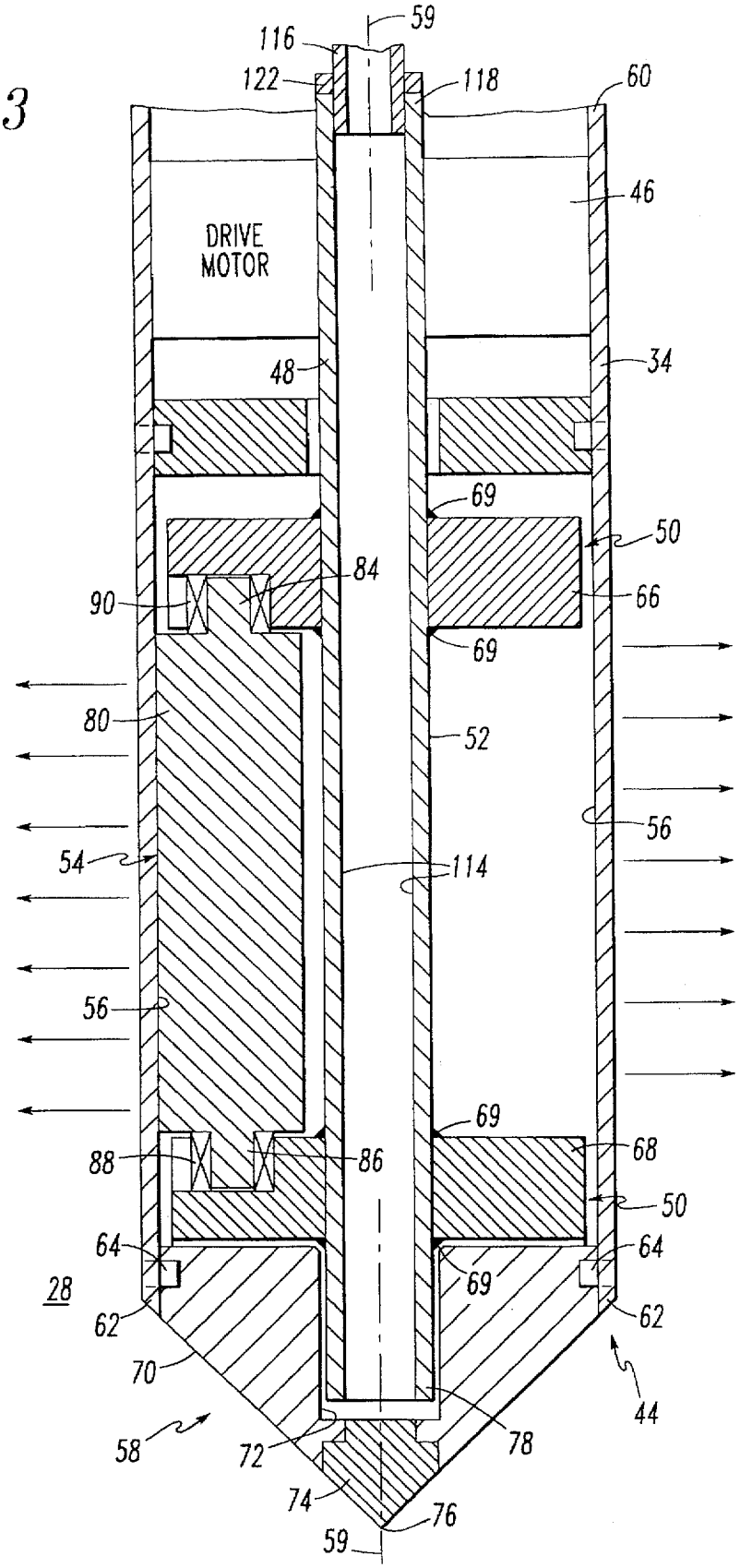
FIG. 3 is a cross-sectional view along line III—III of FIG. 2, with some parts not shown for clarity, of the vibration device including a roller mass.

Also referring to FIG. 3, the vibration device 28 includes a tubular casing assembly 44, a drive motor 46, a hollow tubular drive shaft 48 rotatably driven by the drive motor 46, a carrier assembly 50 attached to the outside surface 52 of the drive shaft 48 for rotation therewith; and a roller assembly 54 in rolling contact with the inside surface 56 of the tubular casing assembly 44. The tubular casing assembly 44 includes the tubular casing 34 and an end cap assembly 58. The tubular casing 34 has the inside surface 56, a vertical longitudinal axis 59, an upper end 60 and a lower end 62. The end cap assembly 58 is attached to the lower end 62 of the tubular casing 34 by fasteners 64.

The drive motor 46 (which is shown in cross section in FIG. 3), such as an electric or hydraulic drive motor, is suitably anchored to the inside surface 56 of the tubular casing 34 and is mounted between such inside surface 56 and the outside surface 52 of the hollow tubular drive shaft 48. In this manner, the hollow tubular drive shaft 48 extends through the drive motor 46 and, thus, provides a conduit therethrough along the vertical longitudinal axis 59. When energized by a power source (not shown), such as an electric or hydraulic line, the drive motor 46 rotates the drive shaft 48. The drive shaft 48 is aligned with the vertical longitudinal axis 59 and the longitudinal length of the tubular casing 34 and is mounted for rotation therein as discussed in greater detail below in connection with FIGS. 4 and 5.

The carrier assembly 50 includes an upper carrier portion 66 and a lower carrier portion 68 which are suitably attached by a plurality of welds 69 to the outside surface 52 of the drive shaft 48 for rotation therewith. The roller assembly 54 is rotatably supported between the upper and lower carrier portions 66,68 of the carrier assembly 50 which engage the roller assembly 54 for rotation about the vertical longitudinal axis 59 of the tubular casing 34. In this manner, the centrifugal force resulting from rotation of the roller assembly 54 is resisted by the inside surface 56 of the tubular casing 34 thereby causing vibration of the tubular casing 34.

As explained in greater detail below in connection with FIGS. 4 and 5, a significant feature of the invention is that the roller assembly 54 is in rolling contact with the inside surface 56 of the tubular casing 34 such that the roller assembly 54 applies its centrifugal force directly to the tubular casing 34 without employing any intermediary bearings to transfer such force. The roller assembly 54 enables the production of high centrifugal force without undue stresses on the bearings 88,90. This makes possible the generation of greater centrifugal force and, hence, greater vibration, than where the load is carried by bearings. This permits an increased diameter of the tubular casing 34, a faster compacting or densifying rate for the soils 30, and a faster installation rate for the vertical structural columns 32 of FIG. 2.

Figure 4:
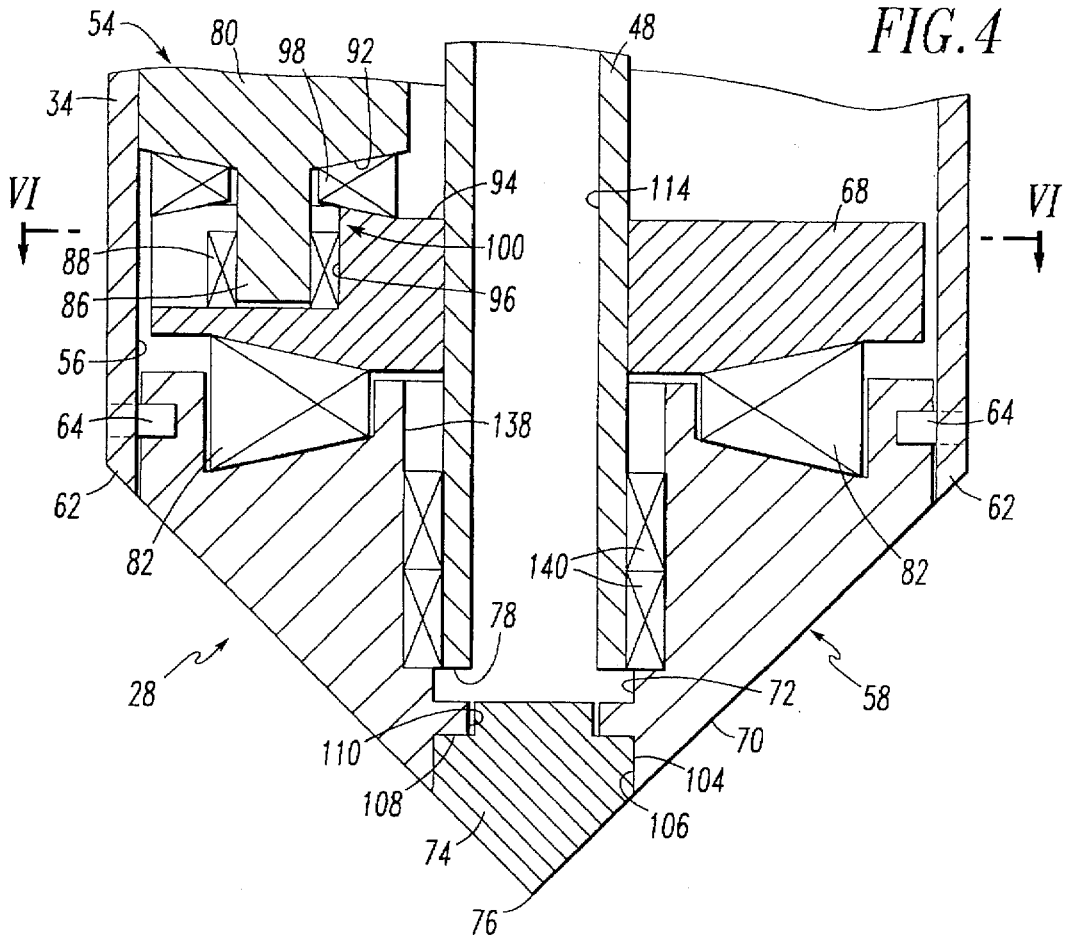
FIG. 4 is an expanded partial view of FIG. 3 illustrating a lower carrier portion and the roller mass.

Referring to FIGS. 3 and 4, the end cap assembly 58 includes a conical member 70 which is attached to the end 62 of the tubular casing 34 with the fasteners 64. The conical member 70 has a longitudinal passageway 72 extending therethrough with the hollow tubular drive shaft 48 extending into the longitudinal passageway 72. The end cap assembly 58 also includes a plug 74 having a conical nose point 76. The plug 74 is disposed within the longitudinal passageway 72 of the conical member 70 at about the end 78 of the drive shaft 48.

The roller assembly 54 includes a cylindrical roller weight 80 rotatably supported between the upper and lower carrier portions 66,68 for rolling about the inside surface 56 of the tubular casing 34 and causing the vibration thereof. The end cap assembly 58 also includes a bearing 82 which rotatably supports the lower carrier portion 68.

The roller assembly 54 further includes an upper end 84, a lower end 86 and the cylindrical roller weight 80 therebetween. As shown in FIG. 4, the lower carrier portion 68 includes a bearing 88 for rotatably supporting the lower end 86 of the roller assembly 54 at the lower carrier portion 68. As shown in FIG. 5, the upper carrier portion 66 includes a bearing 90 for rotatably supporting the upper end 84 of the roller assembly 54 at the upper carrier portion 66. In this manner, the cylindrical roller weight 80 of the roller assembly 54 rolls about the inside surface 56 of the tubular casing 34 thereby minimizing any wear of the bearings 88,90 caused by centrifugal force resulting from rotation of the cylindrical roller weight 80 which is resisted by the inside surface 56 of the tubular casing 34.

Figure 5:
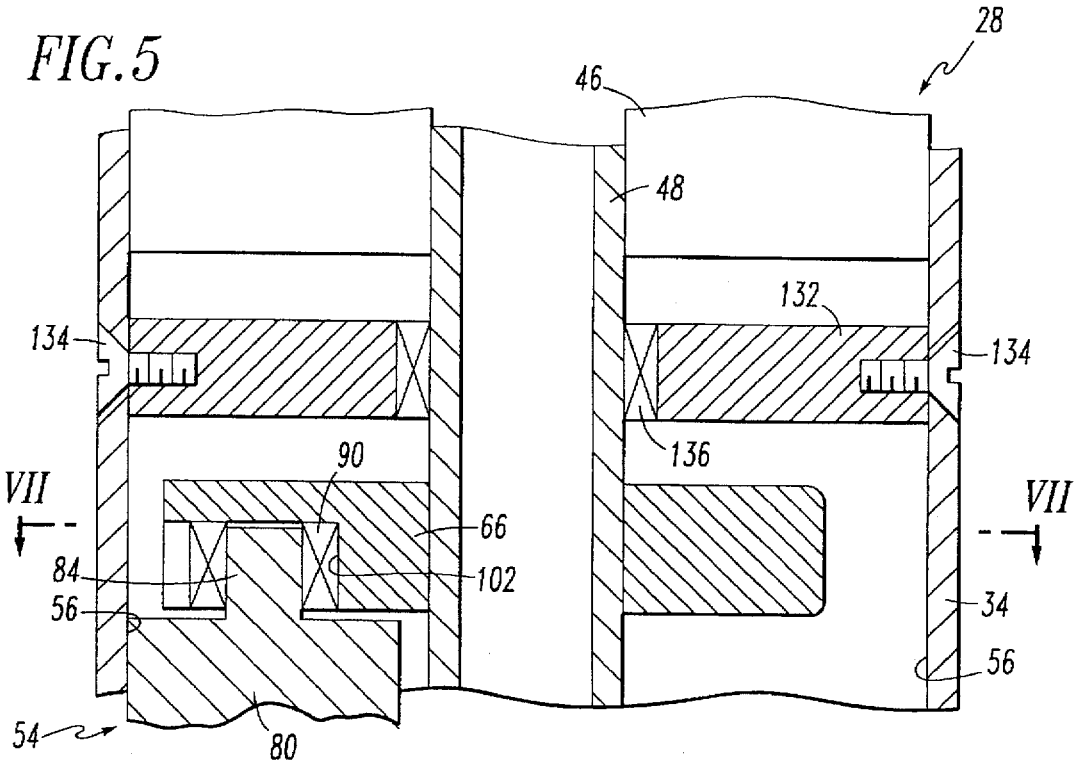
FIG. 5 is an expanded partial view of FIG. 3 illustrating an upper carrier portion and the roller mass.

Continuing to refer to FIGS. 4 and 5, the roller assembly 54 further includes a tapered portion 92 between the lower end 86 and the cylindrical roller weight 80. The lower carrier portion 68 further includes an upper surface 94 having a recess 96 therein holding the bearing 88. Another bearing 98 rotatably supports the tapered portion 92 of the roller assembly 54 on the upper surface 94 of the lower carrier portion 68. The bearings 88,98 form a lower bearing assembly 100 which rotatably supports the roller assembly 54 on the upper surface 94 and within the recess 96 of the lower carrier portion 68. The upper carrier portion 66 has a recess 102 therein. The bearing 90 of the upper carrier portion 66 rotatably supports the upper end 84 of the roller assembly 54 within the recess 102 of the upper carrier portion 66.

Figure 6:
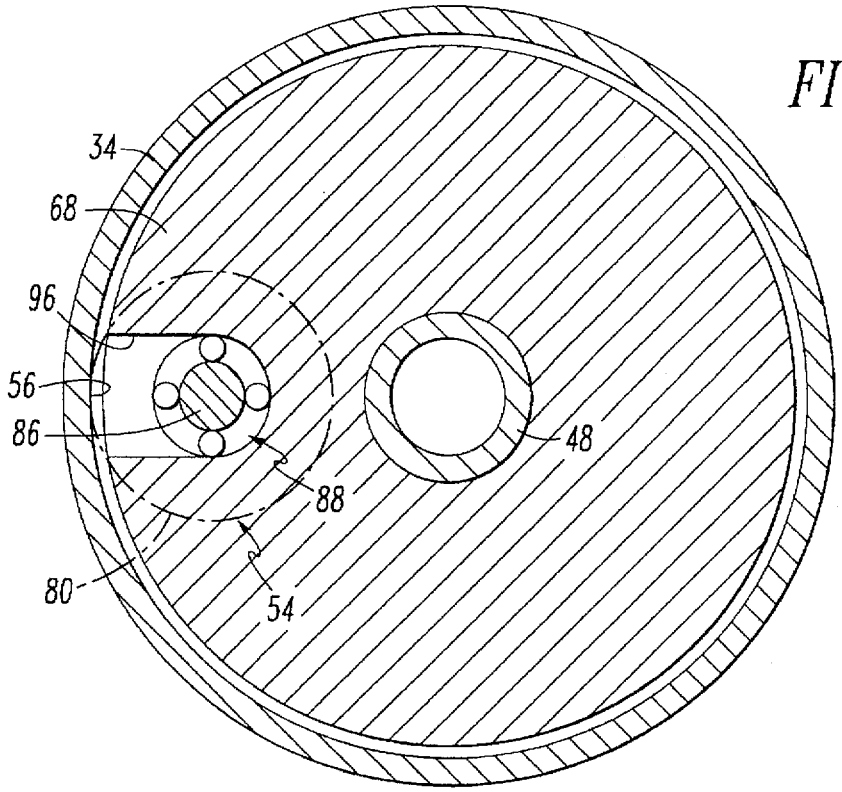
FIG. 6 is a cross-sectional view along line VI—VI of FIG. 4.
Figure 7:
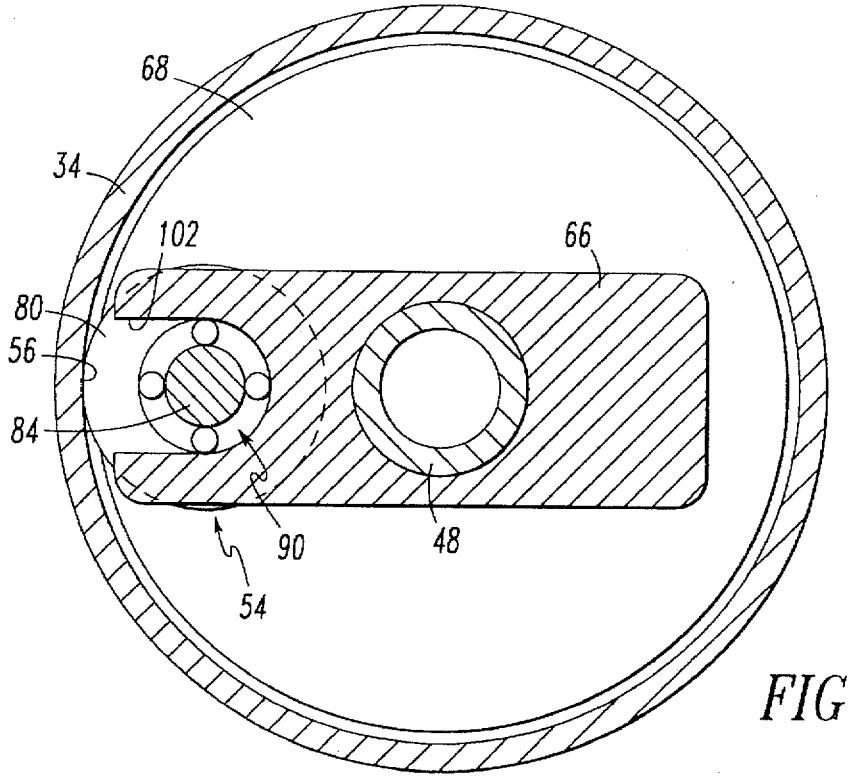
FIG. 7 is a cross-sectional view along line VII—VII of FIG. 5.

FIGS. 6 and 7 respectively illustrate cross-sectional views of the lower carrier portion 68 of FIG. 4 and the upper carrier portion 66 of FIG. 5. As best shown in FIGS. 6 and 7, the cylindrical roller weight 80 (shown in phantom line drawing in FIG. 6) and bearings 88,90 are free to move radially outward toward the inside surface 56 of the tubular casing 34 in the recesses 96,102, respectively, with the centrifugal force resulting from rotation of the cylindrical roller weight 80 forcing such weight 80 against such surface 56. In this manner, any wear of the bearings 88,90 induced by centrifugal force of the roller assembly 54 thereon is substantially eliminated.

Referring again to FIG. 4, the plug 74 is removably disposed within the longitudinal passageway 72 of the conical member 70 by a suitable friction fit between the surface 104 of the plug 74 and the surface 106 of the longitudinal passageway 72. Normally, the plug 74 is positioned at about the lower end 78 of the drive shaft 48 with an upper surface 108 of the plug 74 abutting a shoulder 110 of the longitudinal passageway 72.

Referring again to FIGS. 2 and 3, in the process of compacting and densifying the soils 30 by the vibration device 28, a hole 112 is formed in the soils 30. The tubular casing 34 is disposed within the hole 112. The hole 112 defines the extent of the vertical structural column 32 which, as described in greater detail below, is installed therein. The longitudinal passageway 72 is continuous with the inner surface 114 of the hollow tubular drive shaft 48 which extends through the drive motor 46 to the upper end 60 of the tubular casing 34. The drive shaft 48, in turn, is continuous with a conduit 116 which extends from the upper end 118 of the drive shaft 48 to a fill pump 120 such as a generator and concrete pump. A pressure coupler 122 couples the non-rotating conduit 116 to the rotating upper end 118 of the drive shaft 48.

The crane assembly 38 includes the conduit 116, the fill pump 120, a pressurizer (P) 124 and a valve 126. When the valve 126 is opened, the pressurizer 124 pressurizes the conduit 116 and the inner surface 114 of the drive shaft 48. In this manner, after the soils 30 have been suitably compacted and densified, the longitudinal passageway 72 of the conical member 70 is sufficiently pressurized to eject the removable plug 74 from the longitudinal passageway 72. After the plug 74 is discarded at the bottom of the hole 112, the valve 126 is closed.

The crane assembly 38 further includes a lift mechanism 128 for lifting the follow-up-tube 40 and the tubular casing 34 from the hole 112. As the tubular casing 34 of the vibration device 28 is lifted from the hole 112, the fill pump 120 is energized to inject fill 130, such as concrete, through the conduit 116, through the upper end 118 to the lower end 78 of the drive shaft 48, through the longitudinal passageway 72 of the conical member 70 and into the hole 112. In this manner, the concrete vertical structural column 32 is installed in the hole 112. In an equivalent manner, the removable plug 74 may also be ejected from the longitudinal passageway 72 under the pressure of the fill 130 from the fill pump 120.

Referring again to FIGS. 4 and 5, the vibration device 28 includes a support plate 132 attached with plural fasteners 134 to the inside surface 56 of the tubular casing 34. A bearing 136 between the drive shaft 48 and the support plate 132 rotatably supports the upper portion of the drive shaft 48. A longitudinal recess 138 of the conical member 70 continuous with the longitudinal passageway 72 thereof includes a plurality of bearings 140 between the drive shaft 48 and the recess 138 for rotatably supporting the lower portion of the drive shaft 48. The roller assembly 54, as explained above, applies its centrifugal force resulting from rotation directly to the tubular casing 34 without employing the bearings 136,140 for transferring such force. In this manner, any wear of the bearings 136,140 induced by centrifugal force of the roller assembly 54 thereon is substantially eliminated.

Although a single drive motor 46 is illustrated at about the upper end 60 of the tubular casing 34 of FIG. 3, one or more equivalent drive motors (not shown) may be provided at the upper end 60 and/or the lower end 62 of the tubular casing 34.

While I have illustrated and described a present preferred embodiment of my invention, it is to be understood that I do not limit myself thereto and that my invention may be otherwise variously practiced within the scope of the following claims.

I claim:

1. A centrifugal force vibration apparatus for use in compacting or densifying soils, said apparatus comprising:

tubular casing means having a vertical longitudinal axis and an inside surface;

a drive shaft aligned with the vertical longitudinal axis of said tubular casing means and mounted for rotation therein;

a drive motor for rotating said drive shaft;

means attached to said drive shaft for rotation therewith; and roller means in rolling contact with the inside surface of said tubular casing means, said means attached to said drive shaft engaging said roller means for rotation about the vertical longitudinal axis of said tubular casing means, whereby centrifugal force resulting from rotation of said roller means is resisted by said tubular casing means thereby causing vibration thereof.

2. The apparatus of claim 1 wherein said tubular casing means includes a tubular casing having an end and a longitudinal length which is aligned with the longitudinal axis of said tubular casing means, and end cap means attached to the end of the tubular casing.

3. The apparatus of claim 2 wherein said drive shaft is a hollow tubular member aligned with the longitudinal length of the tubular casing.

4. The apparatus of claim 3 wherein said end cap means includes a conical member attached to the end of the tubular casing, the conical member having a longitudinal passageway extending therethrough, with the hollow tubular member extending through said drive motor and into the longitudinal passageway of the conical member.

5. The apparatus of claim 4 wherein the hollow tubular member has an end; and wherein said end cap means includes a plug disposed within the longitudinal passageway of the conical member at about the end of the hollow tubular member.

6. The apparatus of claim 1 wherein said means attached to said drive shaft includes a first portion and a second portion, with said roller means rotatably supported between the first and second portions.

7. The apparatus of claim 6 wherein said tubular casing means includes a tubular casing having an end and a longitudinal length which is aligned with the longitudinal axis of said tubular casing means, and end cap means attached to the end of the tubular casing; and wherein said end cap means includes bearing means for rotatably supporting the second portion of said means attached to said drive shaft.

8. The apparatus of claim 6 wherein said roller means includes a first end, a second end and a cylindrical roller portion therebetween; and wherein said means attached to said drive shaft further includes first bearing means for rotatably supporting the first end of said roller means at the first portion of said means attached to said drive shaft, and second bearing means for rotatably supporting the second end of said roller means at the second portion of said means attached to said drive shaft, with the cylindrical roller portion of said roller means rolling about the inside surface of said tubular casing means.

9. The apparatus of claim 8 wherein said roller means further includes a tapered portion between the second end and the cylindrical roller portion thereof; wherein the second portion of said means attached to said drive shaft includes a surface having a recess therein; and wherein the second bearing means of said means attached to said drive shaft includes a first bearing rotatably supporting the tapered portion of said roller means on the surface of the second portion, and a second bearing rotatably supporting the second end of said roller means within the recess of the surface of the second portion.

10. The apparatus of claim 8 wherein the first portion of said means attached to said drive shaft has a recess therein; and wherein the first bearing means of said means attached to said drive shaft rotatably supports the first end of said roller means within the recess of the first portion.

11. The apparatus of claim 1 wherein said means attached to said drive shaft includes means for rotatably supporting said roller means.

12. A centrifugal force vibration system for use in compacting or densifying soils, said system comprising:

a tubular casing having a vertical longitudinal axis, an inside surface and an upper end;

means for supporting the upper end of said tubular casing;

a drive shaft aligned with the vertical longitudinal axis of said tubular casing and mounted for rotation therein;

a drive motor for rotating said drive shaft;

means attached to said drive shaft for rotation therewith; and roller means in rolling contact with the inside surface of said tubular casing, said means attached to said drive shaft engaging said roller means for rotation about the vertical longitudinal axis of said tubular casing, whereby centrifugal force resulting from rotation of said roller means is resisted by said tubular casing thereby causing vibration thereof.

13. The system of claim 12 wherein said means attached to said drive shaft includes a first portion and a second portion, with said roller means rotatably supported between the first and second portions.

14. The system of claim 13 wherein said roller means includes a cylindrical roller weight rotatably supported between the first and second portions of said means attached to said drive shaft for rolling about the inside surface of said tubular casing and causing the vibration thereof.

15. A centrifugal force vibration system for use in compacting or densifying soils and installing vertical structural columns therein, said system comprising:

a tubular casing having a vertical longitudinal axis, an inside surface, an upper end and a lower end;

means for at least supporting the upper end of said tubular casing;

end cap means attached to the lower end of said tubular casing;

a hollow tubular drive shaft aligned with the vertical longitudinal axis of said tubular casing and mounted for rotation therein, said hollow tubular drive shaft having an outside surface;

a drive motor between the inside surface of said tubular casing and the outside surface of said hollow tubular drive shaft for rotating said hollow tubular drive shaft;

means attached to the outside surface of said hollow tubular drive shaft for rotation therewith; and roller means in rolling contact with the inside surface of said tubular casing, said means attached to the outside surface of said hollow tubular drive shaft engaging said roller means for rotation about the vertical longitudinal axis of said tubular casing, whereby centrifugal force resulting from rotation of said roller means is resisted by said tubular casing thereby causing vibration thereof.

16. The system of claim 15 wherein said end cap means includes a conical member attached to the lower end of said tubular casing, the conical member having a longitudinal passageway extending therethrough, with said hollow tubular drive shaft extending through said drive motor and into the longitudinal passageway of the conical member.

17. The system of claim 16 wherein said hollow tubular drive shaft has an end; and wherein said end cap means further includes a plug disposed within the longitudinal passageway of the conical member at about the end of said hollow tubular drive shaft.

18. The system of claim 17 wherein the plug is removably disposed within the longitudinal passageway of the conical member; wherein said hollow tubular drive shaft has an inner surface; wherein said means for at least supporting the upper end of said tubular casing includes means for pressurizing the inner surface of said hollow tubular drive shaft, thereby pressurizing the longitudinal passageway of the conical member to eject the removable plug from the longitudinal passageway of the conical member.

19. The system of claim 18 wherein each of said structural columns is installed in a corresponding hole in said soils; wherein said tubular casing is disposed within one of the holes of said soils; wherein the end of said hollow tubular drive shaft is a lower end; wherein said hollow tubular drive shaft also has an upper end; and wherein said means for at least supporting the upper end of said tubular casing further includes means for lifting said tubular casing from said hole and means for injecting fill through the upper end of said hollow tubular drive shaft to the lower end thereof, through the longitudinal passageway of the conical member and into said hole.

20. The system of claim 15 wherein said means attached to the outside surface of said hollow tubular drive shaft includes means for rotatably supporting said roller means.

* * * * *